US005734311A

United States Patent [19]

Murata

[11] Patent Number: 5,734,311

[45] Date of Patent: Mar. 31, 1998

[54] IGNITION APPARATUS FOR INTERNAL-COMBUSTION ENGINE

[75] Inventor: Shigemi Murata, Tokyo, Japan

[73] Assignee: Mitsubishi Denki Kabushiki Kaisha, Tokyo, Japan

[21] Appl. No.: 599,590

[22] Filed: Feb. 9, 1996

[30] Foreign Application Priority Data

May 8, 1995 [JP] Japan ..... 7-109712

[51] Int. Cl.[6] ..... H01F 27/02; H01F 17/06

[52] U.S. Cl. ..... 336/96; 336/110; 336/212; 361/386

[58] Field of Search ..... 336/96, 110, 141, 336/144, 212; 361/386, 331, 356, 388

[56] References Cited

U.S. PATENT DOCUMENTS

| | | | |
|---|---|---|---|
| 4,740,773 | 4/1988 | Buchschmid et al. | 336/96 |
| 4,866,409 | 9/1989 | Umezaki | 336/96 |
| 4,990,881 | 2/1991 | Ooyabu | 336/110 |
| 5,128,645 | 7/1992 | Suda | 336/110 |
| 5,172,302 | 12/1992 | Taruya et al. | 361/386 |

FOREIGN PATENT DOCUMENTS

| | | |
|---|---|---|
| 44 24 129 A1 | 1/1995 | Germany . |
| 3126030 | 12/1991 | Japan . |

*Primary Examiner*—Peter S. Wong
*Assistant Examiner*—Rajnikant B. Patel
*Attorney, Agent, or Firm*—Sughrue, Mion, Zinn, Macpeak & Seas, PLLC

[57] ABSTRACT

An ignition apparatus for an internal-combustion engine comprises a first iron-core section around which a primary coil of an ignition coil is wound; a secondary coil which is wound around the outside of the primary coil; a second iron-core section disposed in the outside of the secondary coil, which forms a closed magnetic path together with the first iron-core section; a housing case which accommodates the primary and secondary coils; and an insulating resin layer composed of first and second resin sections arranged between the housing case and the secondary coil; wherein the first resin section between the second iron-core section and the secondary coil is made thicker than the second resin section which is the part of the insulating resin layer other than the one thereof.

10 Claims, 4 Drawing Sheets

IGNITION APPARATUS FOR INTERNAL-COMBUSTION ENGINE

BACKGROUND OF THE INVENTION

1. Field of the Invention

The present invention relates to an ignition apparatus for an internal-combustion engine which generates a high-voltage at a secondary coil according to a primary current flowing through a primary coil of an ignition coil and applies the high-voltage to an external ignition plug.

2. Description of the Related Art

FIG. 4 is a side sectional view showing an example of a conventional ignition apparatus for an internal-combustion engine. FIG. 5 is a sectional view taken along the line V—V of FIG. 4. FIG. 6 is a sectional view taken along the line VI—VI of FIG. 4. A quadrangular cylindrical-shaped housing case 4 of an ignition coil 100, which has a base, (hereinafter, referred to as a housing case) has a square base hole 4*a* formed in its base. A winding is wound around a square-shaped primary bobbin 2*a* to form a primary coil 2 in the housing case 4, a center axis line of the primary bobbin 2*a* coincides with that of the base hole 4*a* of the housing case 4. A flange portion 2*c* formed in one end of the primary coil 2*a* contacts with the base of the housing case 4 so that the primary coil 2 is arranged. A winding is wound around a secondary bobbin 3*a* to form a secondary coil 3 around the primary coil 2, the secondary coil 3 being disposed keeping a constant distance from the primary coil 2.

As shown in FIG. 4, a side wall hole 4*b* is formed in a lower side wall of the housing case 4. A cylindrical high-voltage tower 6*a* extends from the side wall hole 4*b* vertically toward the outside of the housing case 4, which is integrated with the housing case 4. A high-voltage terminal 6 connected to a high-voltage generating terminal 3*b* of the secondary coil 3 extends to the cylindrical high-voltage tower 6*a*. Each of parts such as the aforementioned primary and secondary 2 and 3 and the like within the housing case 4 is arranged therein. Thereafter, each of the parts is fixed with a resin 7 which is injected between the parts and is hardened. A terminal 5 for an external connection is disposed in one side wall of an opening side of the housing case 4. The terminal 5 has a low-voltage terminal 5*b* coupled electrically to the primary coil 2.

A first iron-core section 1*b* having a section of the square shape passes through the primary coil 2*a*. Furthermore, iron-core holding section 4*c* having a square pipe shape is arranged in an outer side wall of the housing case 4, in parallel with the primary bobbin 2*a*. A second iron-core section 1*c* of a square bar shape passes through the iron-core holding section 4*c*. Both terminals of the first and second iron-core sections 1*b* and 1*c* are connected to each other whereby an iron-core serving as a closed magnetic path is formed. The insulating resin 7 is filled into the gaps between parts. Specially, a first insulating resin layer 7*a* is formed between the secondary coil 3 and the housing case 4; a second insulating resin layer 7*b*, between the primary and secondary coils 2 and 3.

In the ignition apparatus for internal-combustion engine constituted as above, the primary current which is put on/off by a power transistor unit (not shown) and the like flows through the primary coil 2 from the low-voltage terminal 5. A high-voltage is produced in the secondary coil 3 at the time when the primary current is put off, and the high-voltage is provided to an external ignition plug thorough the high-voltage terminal 6.

The iron-core 1 constitutes the closed magnetic path, and it is well enough that any portion of the magnetic path has a gap. FIG. 6 shows an example that the first iron-core section 1*b* has a gap 1*a* at its central portion. The magnitude of the output voltage produced by the secondary coil 3 depends on the presence of the gap 1*a*. In recent years, there has been a technology that a magnet is disposed in the gap 1*a*. Upon disposing the magnet in the gap 1*a*, the secondary coil 3 generates much higher output voltage by the effect of the magnetic field caused by the magnet. Therefore, the higher output voltage can be obtained compared to the case where an iron-core having the same section area as the iron-core 1 is employed. Thus, the size of the apparatus can be reduced.

Momentarily, the iron-core 1 is sometimes made to be the same ground potential as an engine block fixed to the apparatus, and the primary coil 2 sometimes becomes a low voltage of several hundred volts; the secondary coil 3, a high voltage of several tens of kilo-volts. On the other hand, the first insulating resin layer 7 serves to insulate the secondary coil 3 from the second iron-core section 1*c*, and the second insulating resin layer 7*b* serves to insulate the secondary coil 3 from the primary coil 2 and the first iron-core section 1*b*.

A maximum potential difference, between the iron-core 1 and the primary coil 2, the primary coil 2 and the secondary coil 3, and the secondary coil 3 and the iron-core 1, is produced between the secondary coil 3 and the second iron-core section 1*c*. When the maximum potential difference is produced, in some cases, the insulation performance of the first insulating resin layer 7*a* arranged between the secondary coil 3 and the second iron-core section 1*c* is broken down.

When incorporating a magnet in the gap 1*a*, the output voltage produced by the secondary coil 3 is much higher so that in such case the insulation breakdown of the first insulating resin layer 7*a* is more likely to be caused.

The occurrence of the insulation breakdown of the first insulating resin layer 7*a* causes a life time of the ignition apparatus to become shorter and a reliability thereof to decrease. On the other hand, to prevent the insulation breakdown of the first insulating resin layer 7*a* from occurring, a provision of an insulating resin layer having a sufficient thickness will do well. However, such the provision of the insulating resin layer increases the amount of the resin, and this leads to the increase in the weight of the apparatus and the cost. Furthermore, in recent years, the provision thereof runs counter to the demand of the compacted size.

SUMMARY OF THE INVENTION

The present invention is made to solve the above described subjects, and the object of the present invention is to provide an ignition apparatus for an internal-combustion engine which is capable of preventing an insulation breakdown of an insulating resin layer filled therein without increasing the size of the apparatus.

In a first aspect of an ignition apparatus for an internal-combustion engine of the present invention, there is provided a first iron-core section around which a primary coil of an ignition coil is wound; a secondary coil which is wound around the outside of the primary coil; a second iron-core section disposed in the outside of the secondary coil, which forms a closed magnetic path together with the first iron-core section; a housing case which accommodates the primary and secondary coils; and an insulating resin layer composed of first and second resin sections arranged between the housing case and the secondary coil; wherein the first resin section between the second iron-core section and the secondary coil is made thicker than the second resin section.

In the first aspect of the ignition apparatus for the internal combustion engine, the distance between the section iron-core second and the secondary coil is enough, so as not to cause the insulation breakdown of the insulating resin layer filled therebetween, and the size of the apparatus is approximately the same as the conventional one.

In a second aspect of an ignition apparatus for an internal-combustion engine of the present invention, the second iron-core section contacts with the wall of the housing case.

In the second aspect of the ignition apparatus for the internal-combustion engine, since the second iron-core section contacts with the wall of the housing case, there is no gap between the second iron-core section and the housing case.

In a third aspect of an ignition apparatus for an internal-combustion engine of the present invention, the housing case is provided with an iron-core holding section for holding a second iron-core section in the outside of the first resin section.

In the third aspect of the ignition apparatus for the internal-combustion engine, since the housing case is provided with an iron-core holding section for holding a second iron-core section in the outside of the first resin section, the second iron-core section is held in the outside of the first resin section completely.

In a fourth aspect of an ignition apparatus for an internal-combustion engine of the present invention, the closed magnetic path iron-core comprises a gap and a magnet is disposed in the gap.

In the fourth aspect of the ignition apparatus for the internal-combustion engine, since the closed magnetic path iron-core comprises the gap and the magnet is disposed in the gap, the output voltage of the same value as the case where the magnet is not provided can be obtained by virtue of the effect of the magnet, even when the sectional area of the iron-core is reduced.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION OF THE PREFERRED EMBODIMENTS

Embodiment 1

Figure 1:
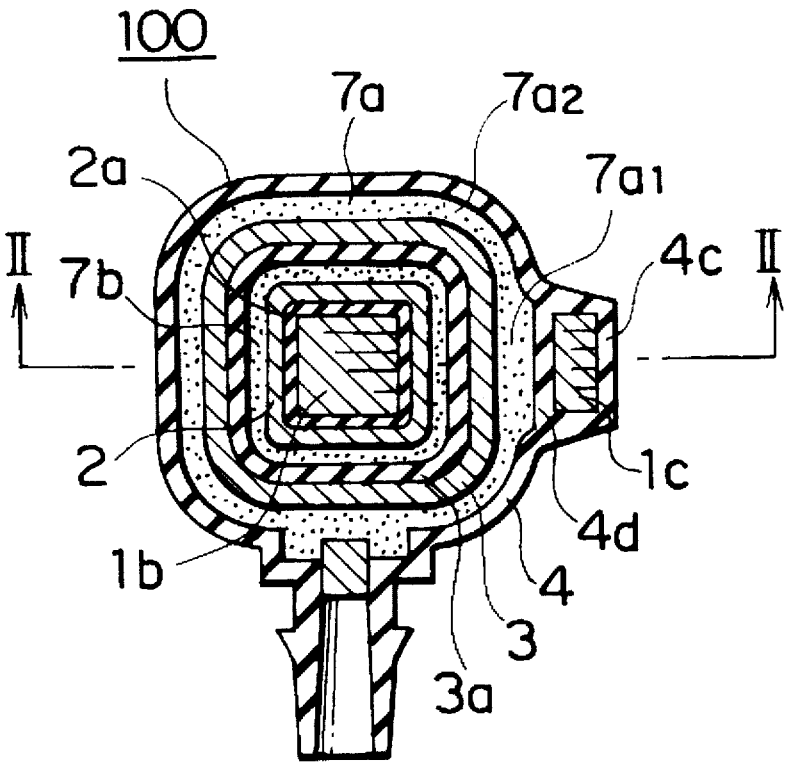
FIG. 1 is a sectional view of an ignition apparatus for an internal-combustion engine showing a first embodiment of the present invention.
Figure 2:
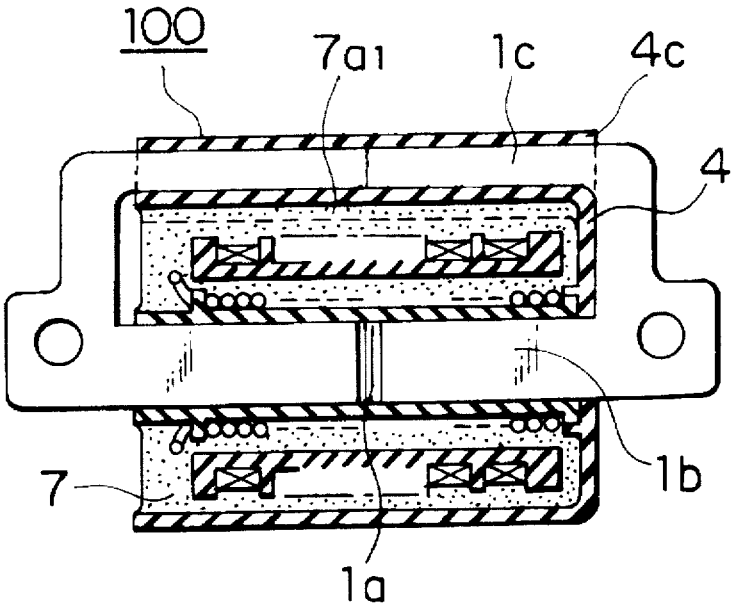
FIG. 2 is a sectional view taken in the direction of the arrows substantially along the line II—II of FIG. 1.

FIG. 1 is a sectional view showing an ignition apparatus for an internal-combustion engine of a first embodiment of the present invention. FIG. 2 is a sectional view taken in the direction of the arrows substantially along the line II—II of FIG. 1. Referring to FIGS. 1 and 2, the same parts as those of the conventional ignition apparatus for the internal-combustion engine and the corresponding parts to those thereof are given with the same reference numerals and explanations for them are omitted.

A first insulating resin layer 7*a* serving as an insulating resin layer is arranged between a housing case 4 and a secondary coil 3. A side wall 4*d* protrudes from the side wall of the housing case 4, the wall 4*d* being a side wall of the housing case 4 as well as a base of an iron-core holding section 4*c* of a square pipe shape disposed on the outer side wall of the housing case 4. For this reason, among the portions of the first insulating resin layer 7*a*, a first resin section 7*a*, between a second iron-core section 1*c* and the secondary coil 3 is made thicker than a second resin section $7a_2$, which is the portion other than the first resin section $7a_1$. In the ignition apparatus for the internal-combustion engine with such constitution, without making all portions of the first insulating resin layer 7*a* thicker, only the first resin section $7a_2$, interposed between the second iron-core section 7*c* and the secondary coil 3 is made thicker than other portions.

Accordingly, the distance between the second iron-core section 1*c* and the secondary coil 3 can be set to be a sufficient one so as not to cause an insulation breakdown of the first resin section $7a_1$. Furthermore, the size of the apparatus is approximately equal to that of the conventional one, and is not so large. Increases in the weight and cost of the apparatus are not caused.

Furthermore, in this embodiment, since the second iron-core section 1*c* contacts tightly with the housing case 4, there is no gap between the second iron-core section 1*c* and the housing case 4. Accordingly, the dimension of the apparatus in the transverse direction in FIG. 1 can be minimized, thereby reducing the size of the apparatus.

Furthermore, in this embodiment, since the housing case 4 comprises an iron-core holding section 4*c* for holding the second iron-core section 1*c* which is located in the outside of the first resin section $7a_1$, the second iron-core section 1*c* is held securely by the outside of the first resin section 7*a*1 so that it never moves anywhere. For this reason, the second iron-core section 1*c* and the secondary coil 3 are insulated from each other completely.

Embodiment 2

Figure 3:
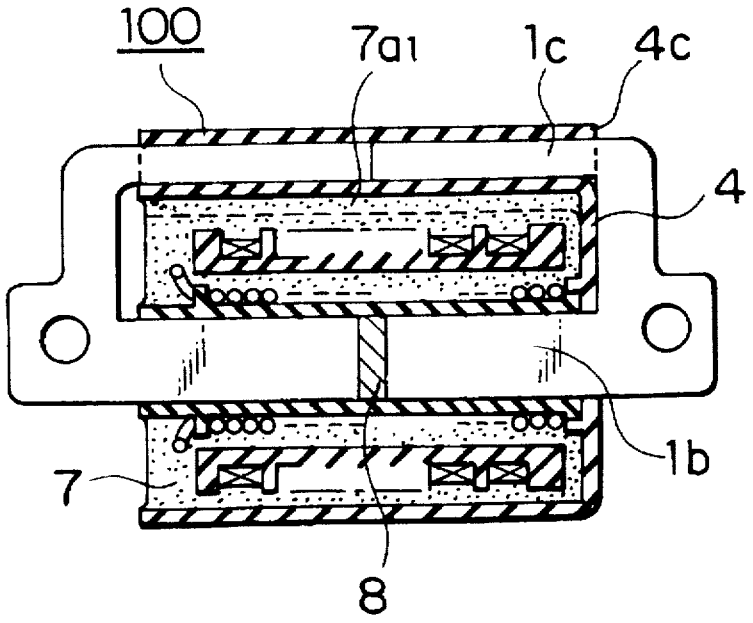
FIG. 3 is a sectional view showing a second embodiment of the present invention wherein a magnet is arranged in a gap of a first iron-core section.
Figure 4:
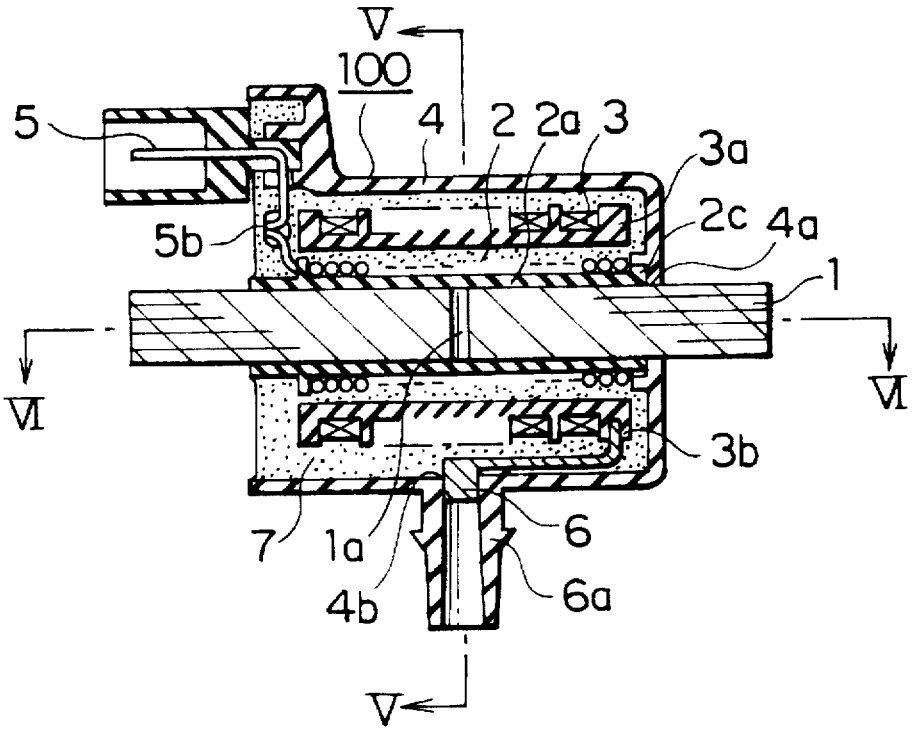
FIG. 4 PRIOR ART
FIG. 4 is a sectional view showing a conventional ignition apparatus for an internal-combustion engines.
Figure 5:
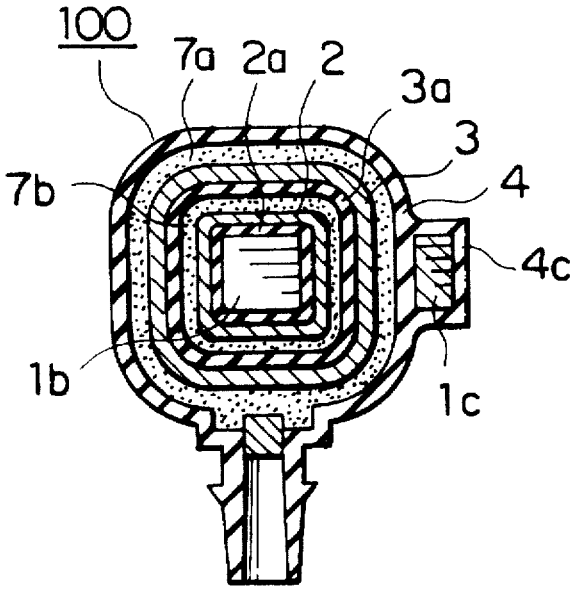
FIG. 5 PRIOR ART
FIG. 5 is a sectional view taken in the direction of the arrows substantially along the line V—V of FIG. 4.
Figure 6:
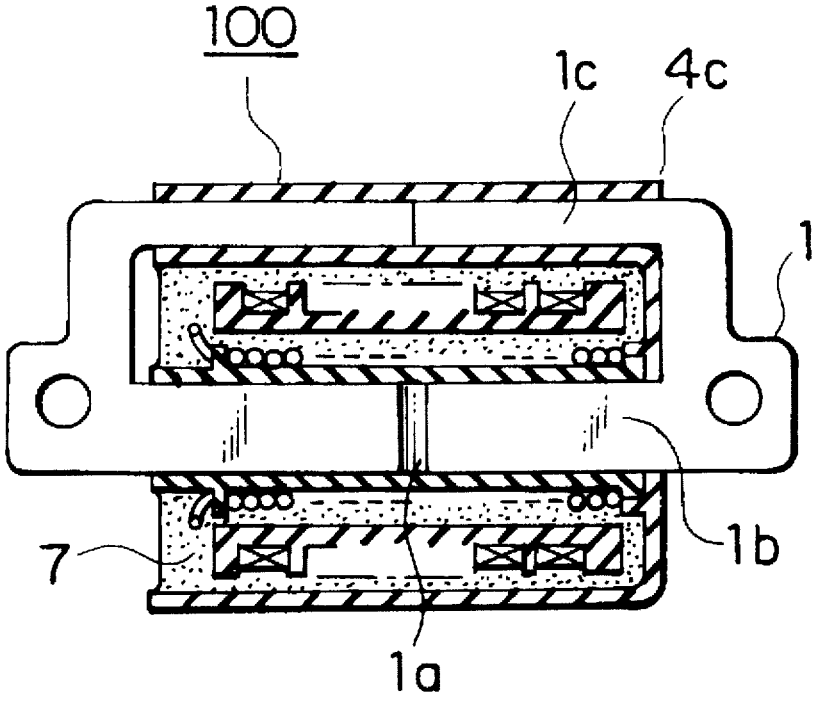
FIG. 6 PRIOR ART
FIG. 6 is a sectional view taken in the direction of the arrows substantially along the line VI—VI of FIG. 4.

FIG. 3 shows a second embodiment of an ignition apparatus for an internal-combustion engine of the present invention, wherein a magnet 8 is arranged in a gap 1*a* of the first iron-core section 1*b*. The gap 1 a may be disposed in any place of a closed magnetic path. When the magnet 8 is disposed in the gap 1*a*, the secondary coil 3 generates much higher output voltage, influenced by the effect of the magnetic field of the magnet 8. Therefore, much higher output voltage can be obtained compared to the output voltage generated by an iron-core of the same section area as the iron-core 1. Contrarily, although the section area of the iron-core 1 is reduced, the output voltage having the same value as that generated by an iron-core which has no magnet 8, can be obtained. The size of the apparatus can be further reduced. In this case, the sectional area of the second iron-core section 1*c* is reduced, and the width of the first resin section $7a_1$ arranged between the second iron-core section 1*c* and the secondary coil 3 is reduced, so that the quantity of the resin used in the apparatus can be much reduced and miniaturization of the size of the apparatus can be obtained.

In the first aspect of the ignition apparatus for the internal-combustion engine of the present invention, there is provided a first iron-core section around which a primary coil of an ignition coil is wound; a secondary coil which is wound around the outside of the primary coil; a second iron-core section disposed in the outside of the secondary coil, which forms a closed magnetic path together with the first iron-core section; a housing case which accommodates the primary and secondary coils; and an insulating resin layer composed of first and second resin sections arranged between the housing case and the secondary coil; wherein since the first resin section between the second iron-core section and the secondary coil is made thicker than the second resin section which is the part of the insulating resin layer, the distance between the second iron-core and the secondary coil is enough, so as not to cause the insulation breakdown of the insulating resin layer filled therebetween, and the size of the apparatus is approximately the same as the conventional one.

In the second aspect of the ignition apparatus for the internal-combustion engine of the present invention, since the second iron-core section contacts with the wall of the housing case, and there is no gap between the second iron-core section and the housing case, the size of the apparatus can be reduced.

In the third aspect of the ignition apparatus for the internal-combustion engine of the present invention, the housing case is provided with an iron-core holding section for holding a second iron-core section in the outside of the first resin section so that the second iron-core section is held in the outside of the first resin section and the insulation of the second iron-core section from the secondary coil is made to be complete.

In the fourth aspect of the ignition apparatus for the internal-combustion engine.of the present invention, since the closed magnetic path iron-core including the first and second iron-core sections comprises a gap and a magnet disposed in the gap, the output voltage of the same value as the case where the magnet is not provided can be obtained by virtue of the effect of the magnet, even when the sectional area of the iron-core is reduced. Thus, the size of the apparatus can be much reduced.

It should be understood that various alternatives to the embodiment of the invention described herein may be implied in practicing the invention. It is intended that the following claims define the scope of the invention and that structures within the scope of these claims and their equivalents be covered thereby.

What is claimed is:

1. An ignition apparatus for an internal-combustion engine, comprising:

a first iron-core section around which a primary coil of an ignition coil is wound;

a secondary coil which is wound around the outside of said primary coil;

a second iron-core section disposed in the outside of said secondary coil, which forms a closed magnetic path together with said first iron-core section;

a housing case which accommodates said primary and secondary coils; and an insulating resin layer composed of first and second resin sections arranged between said housing case and said secondary coil;

wherein said first resin section between said second iron-core section and said secondary coil is made thicker than said second resin section.

2. The ignition apparatus for the internal-combustion engine according to claim 1, said second iron-core section contacts with the wall of said housing case.

3. The ignition apparatus for the internal-combustion engine according to claim 1, wherein said housing case is provided with an iron-core holding section for holding said second iron-core section in the outside of said first resin section.

4. The ignition apparatus for the internal-combustion engine according to claim 1, wherein a gap is formed in the iron-core constituting said closed magnetic path and a magnet is disposed in said gap.

5. The ignition apparatus according to claim 1, wherein said second resin section is between said housing case and said secondary coil to surround said secondary coil except for in the region between said second iron-core section and said secondary coil.

6. The ignition apparatus according to claim 1, wherein the distance between said second iron-core section and said secondary coil is sufficient to allow enough resin to be disposed in said first resin section to prevent insulation breakdown of said first resin section during normal operation.

7. The ignition apparatus according to claim 4, wherein the distance between said second iron-core section and said secondary coil is sufficient to allow enough resin to be disposed in said first resin section to prevent insulation breakdown of said first resin section during normal operation.

8. The ignition apparatus according to claim 5, wherein the distance between said second iron-core section and said secondary coil is sufficient to allow enough resin to be disposed in said first resin section to prevent insulation breakdown of said first resin section during normal operation.

9. The ignition apparatus according to claim 2, wherein said second iron-core section contacts the entire corresponding surface of said wall of said housing case.

10. The ignition apparatus according to claim 3, wherein said second iron-core section is completely outside of said first resin section.

* * * * *